United States Patent [19]

Blewett et al.

[11] Patent Number: 4,584,140

[45] Date of Patent: Apr. 22, 1986

[54] PROCESS FOR SEPARATING FATTY MATERIALS FROM SUPPORTED NICKEL CATALYSTS

[75] Inventors: Charles W. Blewett, Fort Mitchell, Ky.; Stephen W. Turner, Hamilton, Ohio

[73] Assignee: National Distillers and Chemical Corporation, New York, N.Y.

[21] Appl. No.: 682,404

[22] Filed: Dec. 17, 1984

[51] Int. Cl.[4] ..... C11B 1/10

[52] U.S. Cl. ..... 260/412.8; 260/428.5; 502/27; 502/34

[58] Field of Search ..... 260/412.8, 428.5; 502/34, 27

[56] References Cited

U.S. PATENT DOCUMENTS 4,280,961 7/1981 Schneider et al. ..... 260/412.8

FOREIGN PATENT DOCUMENTS 2853065 6/1980 Fed. Rep. of Germany ..... 502/34

*Primary Examiner*—Charles F. Warren
*Assistant Examiner*—Elizabeth A. Flaherty
*Attorney, Agent, or Firm*—Kenneth D. Tremain; Gerald A. Baracka

[57] ABSTRACT

A process for recovering fatty materials, such as fatty acids and lower alkyl esters thereof, from supported nickel catalyst compositions is provided. For the process, the supported nickel catalyst composition, which may also contain non-nickel containing clays/earths, is extracted with a supercritical fluid, preferably supercritical carbon dioxide, to separate the fatty material from the supported nickel catalyst composition.

7 Claims, No Drawings

PROCESS FOR SEPARATING FATTY MATERIALS FROM SUPPORTED NICKEL CATALYSTS

BACKGROUND OF THE INVENTION

1. Field of the Invention

This invention relates to a novel process for separating fatty materials, such as fatty acids, from supported nickel catalysts. More specifically, the process involves subjecting the supported nickel catalyst containing the fatty material to supercritical fluid extraction, separating the fatty material and supported nickel catalyst and recovering same.

2. Description of the Prior Art

Supported nickel catalysts are utilized in numerous hydrogenation processes where low IV (iodine value) fatty products, i.e., products which are completely or essentially completely saturated, are desired. A considerable amount, sometimes up to about as much as 60 percent by weight, fatty material can be associated with the supported nickel catalyst or supported nickel catalyst and clay/earth mixtures. This can result in a substantial reduction in the yield of the process. The presence of fatty materials with the supported nickel catalyst also significantly impairs the catalyst activity so that it is impractical to recycle the catalyst. The presence of these fatty products even complicates processing the catalyst for recovery of the nickel value.

Procedures for the recovery of fatty materials from bleaching earths and clays are known. One such process for the recovery of polymeric fatty acids is described in U.S. Pat. No. 3,873,585. Also, in U.S. Pat. No. 4,049,685 a process for washing fatty acids from spent clay with aqueous alkali at elevated temperatures while maintaining a specified pH of 5–6.5 is disclosed. U.S. Pat. No. 4,110,356 describes a procedure for deoiling spent clay by slurrying the spent clay with aqueous alkali at a temeprature of at least 80° C. and with a water to clay ratio of about 2–6:1. Similarly, U.S. Pat. No. 4,283,346 discloses the recovery of oil from clays by alkali treatment under high temperature and high pressure followed by the addition of an acid. A process for extracting residual vegetable oil contained in spent bleaching clays with an aliphatic hydrocarbon solvent and then reprocessing the bleaching clay for use is described in U.S. Pat. No. 4,285,832.

Procedures for the extraction of various fatty materials utilizing supercritical fluids are also known and such processes are described in U.S. Pat. Nos. 3,969,382, 4,156,688, 4,250,331, 4,280,961 and 4,422,966. The regeneration of adsorbents by removal of the adsorbate by contacting with a supercritical fluid is described in U.S. Pat. Nos. 4,061,566 and 4,124,528.

It would be highly advantageous to have a process whereby fatty materials could be readily removed from spent supported nickel catalysts and mixtures of such catalysts with clays and/or earths such as are employed for bleaching, deodorization and to assist in filtering. It would be even more desirable if an extraction process utilizing supercritical fluids were available wherein spent supported nickel catalysts obtained from various fatty processes could be treated to extract the adsorbed fatty material and if both the fatty material and catalyst could be recovered and subsequently used.

SUMMARY OF THE INVENTION

We have now discovered a novel process wherein fatty materials, such as fatty acids, are readily separated from supported nickel catalyst compositions. In its broadest aspects the present process involves subjecting a supported nickel catalyst composition containing up to as much as 60 percent by weight fatty material to extraction with a supercritical fluid to substantially separate the fatty material from the supported nickel catalyst composition. Carbon dioxide is preferably employed as the fluid for the process of this invention. The process has particular application for the recovery of structurally modified, i.e., branched-chain, acids from spent supported nickel hydrogenation catalysts and mixtures of such spent catalysts with clays/earths employed as filter aids or for bleaching and/or deodorizing.

More specifically, the process of this invention comprises (a) contacting the supported nickel catalyst composition having up to 60 percent by weight fatty material associated therewith with a fluid maintained in a supercritical state for a time sufficient to dissolve a substantial portion of the fatty material in said fluid; (b) separating said fluid having said fatty material dissolved therein and maintained in the supercritical state from the supported nickel catalyst composition; (c) subjecting said fluid having the fatty material dissolved therein obtained from step (b) to conditions which convert the fluid to a non-supercritical state; (d) separating the fatty material from the fluid which is maintained in a non-supercritical state; and (e) recovering the fatty material from step (d) and the supported nickel catalyst composition from step (b). In an especially useful embodiment of this invention, the supported nickel catalyst composition is treated with sulfuric acid before contacting with the supercritical fluid.

DETAILED DESCRIPTION

The present invention relates to a process whereby supported nickel compositions having a fatty material associated therewith, such as spent supported nickel catalysts obtained from the hydrogenation of fatty acids, are subjected to supercritical fluid extraction to substantially remove the fatty material from the supported nickel catalyst composition. For the purpose of this invention the term "supported nickel composition" refers to any solid support material having nickel deposited thereon or reacted therewith, such as supported nickel hydrogenation catalysts, or to mixtures thereof with earths and/or clays, such as mixtures wherein a supported nickel catalyst is present with a diatomaceous earth filter aid or bleaching clay.

Spent supported nickel catalyst compositions treated in accordance with the process of this invention may be any spent nickel catalyst derived from any source. Catalysts obtained from industrial fatty acid processing operations are, however, most advantageously employed. Spent supported nickel catalysts obtained from processes for the hydrogenation of fats and oils, fatty acids and fatty acid lower alkyl esters are particularly useful. The process of this invention is not only applicable to spent supported nickel catalysts, i.e., catalysts which no longer possess sufficient activity and whose only value is in recovery of the nickel value, but it is also adaptable for use with supported nickel catalysts which are sufficiently active to warrant further catalytic use. In this latter instance, by the removal of fatty material from the supported nickel catalyst it is possible to realize a significant improvement in catalyst activity.

The present process is particularly useful for the treatment of fatty acid-containing spent supported nickel catalysts or mixtures containing same. Such spent nickel catalyst compositions are widely available from fatty processors and are typically sold to "reclaimers" who recover the nickel from the spent catalyst and safely dispose of the residue. Since the price paid to the fatty processor for the spent nickel catalyst is based on the weight percent nickel present in the spent catalyst, it is advantageous for the fatty processor to have as much of the fatty acid removed from the spent catalyst as is practically possible. This not only increases the value of the spent catalyst to the fatty processor but also increases the overall yield of the fatty acid obtained from the process.

Furthermore, removal of the fatty acid from the spent nickel catalyst is also advantageous from the standpoint of the reclaimer since the presence of organic impurities, and particularly fatty contaminants, complicates the nickel recovery process. Such organic impurities must be removed before the spent nickel catalyst can be leached with an inorganic acid to dissolve the nickel. Heretofore, this has typically been accomplished by the reclaimer by calcining at an elevated temperature or by extraction with an organic solvent, such as Stoddard solvent. Thus, when the spent supported nickel catalyst is essentially free of fatty organic impurities, the reclaimer can eliminate a step from the nickel recovery operation. By the process of this invention, it is therefore possible for both the fatty processor and the nickel reclaimer to realize an economic advantage.

The spent supported nickel catalysts treated in accordance with the process of this invention can be derived from any of the commonly used supports, such as Kieselguhr, carbon, charcoal, alumina, silica, silica-alumina, and the like, and can have widely varying nickel contents. Nickel-containing catalysts of this type, useful for hydrogenation of unsaturated fatty materials and methods for this preparation are well known. The supported nickel catalysts can be in powder form or in the form of extruded pellets or the like.

The fatty material will generally be a fat or oil, a fatty acid, a lower alkyl ester of a fatty acid, or polymeric fatty acid, e.g., dimer or trimer, or a mixture of two or more of such materials. The fatty material is most usually saturated but may contain some unsaturation. The amount of fatty material associated with the supported nickel catalyst composition can be as high as 60 weight percent and most generally will be from about 30 to 60 weight percent.

In addition to being useful for the separation of fatty materials from spent supported nickel hydrogenation catalysts, the process is also advantageously employed for the treatment of spent nickel catalyst compositions which additionally contain one or more non-nickel containing clay or earth materials. Compositions of this type are obtained when, as is commonly the case, a clay or earth is employed in the operation. It is well known in fatty operations to utilize clays and/or earths for the purpose of improving filtration or to improve the quality of the hydrogenated fatty product, i.e., decolorize and/or deodorize.

Clays employed may be any of the common crystalline clay minerals such as montmorillonite, kaolinite, hectorite, halloysite, attapulgite, sepiolite or the like. The clays may be activiated by treatment with acid or a base or may be used in their naturally occurring state. Soft earthy materials, such as diatomite (Kieselguhr) or perlite may also be present with the supported nickel catalyst or supported nickel catalyst/clay mixture. The particle size of the supported nickel catalyst, clay and earth is not critical for the process of this invention and may vary widely.

Spent nickel-containing compositions obtained from the hydrogenation of structurally modified fatty acids in accordance with the process of U.S. Pat. No. 2,812,342 and, which are mixtures of a supported nickel catalyst, a clay and an earth, are particularly useful for extraction with supercritical fluids by the process of the present invention. In the process of U.S. Pat. No. 2,812,342, an unsaturated fatty acid or mixed fatty acid is polymerized using known procedures. In addition to polymerization, a certain amount of the unsaturated fatty acid undergoes isomerization to form unsaturated branched-chain isomers. The branched-chain fatty acids (and any saturated acids which were present in the reaction mixture and which are not polymerized) are distilled from the polymeric fatty acid product and subsequently hydrogenated to an iodine value of 3–10 using a supported nickel hydrogenation catalyst. The hydrogenated material is then separated from the nickel catalyst. A filter aid is typically added to the mixture to facilitate the separation, i.e., prevent clogging of the filter and obtain acceptable filtration rates. The filter cake, which consists of a mixture of the spent nickel catalyst and the filter aid and containing up to 60 percent by weight fatty acids, is advantageously extracted in accordance with the process of this invention. Mixtures wherein the nickel catalyst consists of from 10 to 60 weight percent nickel deposited on Kieselguhr and the filter aid is an acid-activated montmorillonite clay are commonly obtained from such processes for the preparation of the structurally modified acids.

Substantially all of the fatty acids can be removed from the filter cake utilizing the supercritical fluid extraction process resulting in a two-fold advantage to the fatty acid manufacturer. In the first place, more of the fatty acids produced by the process are recovered thereby increasing the overall yield. Secondly, by removing the fatty acids from the filter cake, the weight percent nickel in the mixture is proportionately increased thus rendering the spent nickel catalyst composition more valuable from the standpoint of sale for recovery of the nickel value. The nickel recovery process is also simplified as a result of removal of the organic (fatty acid) residues.

In a particularly useful embodiment of this invention, supported nickel catalyst compositions obtained from the hydrogenation of structurally modified fatty acids are treated with a mineral acid prior to extracting with the supercritical fluid. For the acid treatment, the supported nickel catalyst composition is contacted with an essentially equimolar amount of the mineral acid, based on the amount of nickel in the supported nickel catalyst composition. Useful mineral acids for this purpose include hydrochloric acid, sulfuric acid, phosphoric acid, and nitric acid. Superior results are obtained utilizing sulfuric acid, particularly when supercritical carbon dioxide is utilized for the extraction.

The use of fluids which are maintained in their supercritical state, that is, at a temperature above the critical temperature and pressure above the critical pressure, for extraction procedures is well known. Fluids maintained in a supercritical state are recognized to have properties between a gas and a liquid and to have superior solvent capabilities. While conventional extraction of organic impurities from spent supported nickel catalysts with organic solvents at below critical conditions is known, it was not foreseeable how the organic impurities would be extracted under supercritical conditions, particularly with catalyst/clay mixtures contaminated with a fatty acid mixture wherein the predominant fatty acids are structurally modified, i.e., branched.

Fluids which have been utilized for supercritical fluid extraction and which can be utilized for the process of this invention include both organic and inorganic fluids. Organic fluids include hydrocarbons, such as benzene, methane, ethane, butane, hexane, ethylene, and the like; halogenated hydrocarbons, such as dichlorodifluoromethane, trichlorofluoromethane, chlorotrifluoromethane, dichlorotetrafluoroethane, and the like; and alcohols such as ethanol, isopropanol and the like. Inorganic fluids that can be used include carbon dioxide, which is particularly advantageous, ammonia, sulfur dioxide, nitrous oxide and the like. Critical temperatures and pressures are reported in the literature for these gases.

In general, for the process of this invention the operating temperature is maintained from about 1° C. above the critical temperature up to as much as 75° C. above the critical temperature. Similarly, the pressure is maintained from about 1 psi above the critical pressure up to as much as 5000 psi above critical. Preferably, temperatures are maintained from about 5° to 40° C. above critical temperature with pressures maintained at about 50 to 3000 psi above critical.

As previously indicated, carbon dioxide is a preferred fluid for the instant invention in view of its ready availability and critical properties. The critical temperature for carbon dioxide is 31° C. and critical pressure is 72.85 atmospheres (1071 psi). When carbon dioxide is employed in the supercritical state, the temperature and pressure generally range from 31° to 100° C. and 1071 psi to 5000 psi, respectively. More usually with $CO_2$ the temperature will be from 35° to 65° C. and pressure from 2500 psi to 4000 psi.

The present process is carried out in accordance with established procedures for supercritical extractions. In general this requires a means for maintaining the fluid in a supercritical state and contacting the supercritical fluid with the spent supported nickel catalyst composition. A high pressure reactor with suitable contacting means is typically used for this purpose. A means is also provided to remove the supercritical fluid containing the fatty material from the spent supported nickel catalyst composition and separating the fatty material from the fluid. Separation is accomplished by lowering the solubility of the fatty material in the fluid. This can be achieved by lowering the temperature below the critical temperature, lowering the pressure below the critical pressure, or a combination of these operations. If the process is conducted in a continuous manner a means must also be provided to return the fluid to a supercritical state and to recontact the regenerated supercritical fluid with the supported spent nickel catalyst composition. While the method and mode of operation will vary, the amount of fatty material extracted depends primarily on the particular fluid used for the extraction and the time and conditions of contact.

The following examples illustrate the supercritical fluid extraction process of the present invention more fully but are not intended as a limitation on the scope thereof. For these examples, a 1"×12" cylindrical commercial high pressure autoclave was employed. A gas inlet connected to a high-pressure $CO_2$ reservoir was provided at the bottom of the reactor. A valve and pressure regulator were located in the line connecting the gas reservoir and the autoclave. Both the autoclave and reservoir were fitted with appropriate gauges, vent valves and rupture discs and placed in constant temperature baths. $CO_2$ was vented through an outlet at the top of the reactor to a jacketed micrometering valve where the gas was expanded to atmospheric pressure. Fatty materials were condensed and collected in glass sample traps maintained in an ice bath and the $CO_2$ passed through a wet test meter to determine its volume. As will be evident to those skilled in the art, numerous modifications of the design and arrangement of the process equipment are possible.

EXAMPLE 1

Forty grams of the filter cake recovered from the hydrogenation of mixed fatty acids obtained from the dimerization of oleic acid in accordance with the procedure of U.S. Pat. No. 2,812,342 was charged to the high-pressure autoclave (extractor). The filter cake was comprised of essentially equal proportions of the spent nickel catalyst (nickel on Kieselguhr) and clay filter aid and contained approximately 40% by weight mixed fatty acids—predominantly of $C_{18}$ and $C_{16}$ fatty acids present in a ratio of about 3:1. Nickel content of the filter cake, determined by atomic absorption, was 7.8% by weight. Glass wool plugs held in place by wire screens were placed below and above the material to prevent particulates from being blown through the system. The extractor was sealed, positioned in the temperature bath (preheated to extraction temperature—50° C.) and connected to the inlet and outlet tubes. The extractor was then pressurized to 2500 psi with carbon dioxide from the high-pressure gas reservoir and maintained at this pressure by setting the inline pressure regulator. Pressure in the gas reservoir was maintained above that of the extractor, but less than 4300 psi, by periodically turning on the gas pressure pump. Temperature of the high-pressure gas reservoir was maintained 10°–15° C. above the temperature of the extractor to compensate for isothermal and/or isoenthalpic expansion of the carbon dioxide across the regulator. Carbon dioxide was heated above 31° C. prior to pumping to prevent liquifaction in the pump head. Flow of carbon dioxide through the extractor was maintained at about 8 SCFH by adjustment of the micrometering valve.

The extraction was stopped periodically (after about 60 liters of carbon dioxide was utilized) and the traps removed and weighed to determine the extent of extraction. This procedure was repeated until the desired amount of extraction was obtained. Weight % extract, weight % residue, % recovery and equilibrium weight % solubility were calculated as follows:

$$\text{Weight \% Extract} = \frac{\text{Extract Weight}}{\text{Charge Weight}} \times 100$$

$$\text{Weight \% Residue} = \frac{\text{Residue Weight}}{\text{Charge Weight}} \times 100$$

$$\text{\% Recovery} = \frac{\text{Extract Weight} + \text{Residue Weight}}{\text{Charge Weight}} \times 100$$

$$\text{Equilibrium Weight \% Solubility} = \frac{\text{Extract Weight*}}{\text{Weight of } CO_2\text{**}} \times 100$$

-continued

*during linear portion of extraction
**determined from volume

The following results were obtained for the above extraction:

Weight % Extract—27.5
Weight % Residue—64.9
% Recovery—92.4
Equilibrium Weight % Solubility—0.91

The extract had acid value of 166.7, saponification value of 196.8, and contained less than 10 ppm nickel. Gas chromatographic analysis of the extract showed it to contain 6.8% $C_{14}$ acids, 5.8% branched $C_{16}$ acids, 16.4% n-$C_{16}$ acid, 37.5% branched $C_{18}$ acids, 27.9% n-$C_{18}$ acid, and 3.5% other acids. The residue obtained after extraction contained 12.0% nickel.

EXAMPLES 2-6

To demonstrate the versatility of the extraction process, a series of extractions were carried out at 65° C. in accordance with the procedure of Example 1. The pressure was varied from 2000 to 4000 psi. Results obtained for these extractions were as follows:

| | Ex. 2 | Ex. 3 | Ex. 4 | Ex. 5 | Ex. 6 |
|---|---|---|---|---|---|
| Pressure (psi) | 2000 | 2500 | 3000 | 3500 | 4000 |
| Wt. % Extract | 7.2 | 22.4 | 24.3 | 24.0 | 24.8 |
| Wt. % Residue | 78.4 | 68.5 | 70.4 | 65.8 | 66.3 |
| % Recovery | 85.7 | 90.8 | 94.7 | 89.8 | 91.2 |
| Equilibrium Wt. % Solubility | 0.30 | 0.69 | 1.50 | 1.99 | 2.86 |
| AV of Extract | 163.8 | 178.2 | 182.2 | 183.8 | 173.1 |
| SV of Extract | 177.3 | 183.5 | 202.2 | 181.4 | 183.5 |

EXAMPLES 7-10

Following the procedures of Examples 3-6, except that the filter cake treated with concentrated sulfuric acid prior to extraction, the following experiments were carried out. An equimolar amount of concentrated sulfuric acid, based on the nickel content of the spent nickel catalyst composition, was utilized. Results of these extractions were as follows:

| | Ex. 7 | Ex. 8 | Ex. 9 | Ex. 10 |
|---|---|---|---|---|
| Pressure (psi) | 2500 | 3000 | 3500 | 4000 |
| Wt. % Extract | 33.3 | 36.7 | 34.4 | 36.4 |
| Wt. % Residue | 60.4 | 60.2 | 60.0 | 36.4 |
| % Recovery | 93.8 | 96.9 | 94.4 | 95.6 |
| Equilibrium Wt. % Solubility | 1.05 | 3.65 | 4.74 | 8.55 |
| AV of Extract | 189.6 | 180.9 | 191.3 | 192.2 |
| SV of Extract | 190.4 | 195.2 | 210.7 | 193.9 |

It is apparent from the above data that improved results are obtained by treating the filter cake with mineral acid prior to extraction. Much higher equilibrium weight percent solubility, which is a measure of the effectiveness of the extraction per unit of the supercritical fluid, is achieved with acid pretreatment. Also, higher acid values and saponification values of the extract are achieved when the filter cake is treated with mineral acid prior to extraction.

EXAMPLE 11

A filter cake obtained from the hydrogenation of a fatty acid mixture, recovered from the dimerization of tall oil fatty acids in accordance with the procedure of U.S. Pat. No. 2,812,342, was extracted in accordance with the procedure of this invention. The filter cake contained approximately 40% by weight fatty acids (about 80% $C_{18}$ aliphatic monocarboxylic acids; ratio of branched to normal $C_{18}$ acids about 1.5:1). Nickel content of the filter cake was 4.7 weight percent. Extraction of the spent supported nickel catalyst composition at 65° C. and 4000 psi gave the following results:

Weight % Extract—27.7
Weight % Residue—59.8
% Recovery—87.6
Equilibrium Weight % Solubility—4.75

The extract had acid value of 161.7, saponification value of 219.8, and contained less than 5 ppm nickel. Gas chromatographic analysis of the extract showed it to contain 1.0% $C_{14}$ acids, 0.8% branched $C_{16}$ acids, 9.5% n-$C_{16}$ acid, 47.6% branched $C_{18}$ acids, 31.0% n-$C_{18}$ acid, and 10.1% other acids. The nickel content of the residue remaining after extraction was 7.9 weight percent.

EXAMPLE 12

The procedure of Example 11 was repeated except that the filter cake was pretreated with a stoichiometric amount (based on the nickel content) of concentrated sulfuric acid prior to extraction. For the pretreatment, 3.3 mls concentrated sulfuric acid was mixed with 40 grams of the filter cake prior to charging to the reactor. Upon extraction, the following results were obtained:

Weight % Extract—34.7
Weight % Residue—58.5
% Recovery—93.1
Equilibrium Weight % Solubility—6.5

The extract obtained from the process had an acid value of 176.1, saponification value of 206.9, and contained less than 5 ppm nickel. Gas chromatographic analysis of the extract showed it to contain 0.9% $C_{14}$ acids, 0.8% branched $C_{16}$ acids, 9.1% n-$C_{16}$ acid, 48.2% branched $C_{18}$ acids, 31.3% n-$C_{18}$ acid, and 9.8% other acids.

We claim:

1. The process wherein the fatty material is a fatty acid or lower alkyl ester thereof and constitutes from about 30 to 60 weight percent of the supported nickel catalyst composition.

2. The process of claim 1 wherein the supercritical fluid is carbon dioxide maintained at a temperature from 31° C. to 100° C. and pressure from 1071 psi to 5000 psi.

3. The process of claim 2 wherein the supported nickel catalyst composition is obtained from the hydrogenation of structurally modified fatty acids produced during the polymerization of unsaturated fatty acids.

4. The process of claim 3 wherein the supercritical carbon dioxide is maintained at 35° C. to 65° C. and 2500 psi to 4000 psi.

5. The process of claim 4 wherein the mineral acid is sulfuric acid.

6. The process of claim 5 wherein the supported nickel catalyst composition is a mixture of spent supported nickel hydrogenation catalyst with a non-nickel containing clay or earth material.

7. A process for treating a supported nickel catalyst composition containing a fatty material which comprises:

(a) contacting the supported nickel catalyst composition having up to 60 percent by weight fatty material associated therewith with an essential equimolar amount, based on the amount of nickel in the supported catalyst composition, of a mineral acid;

(b) contacting the acid-treated supported nickel catalyst composition obtained from step (a) with a fluid maintained in a supercritical state for a time sufficient to dissolve a substantial portion of the fatty material in said fluid;

(c) separating said fluid having said fatty material dissolved therein and maintained in the supercritical state from the supported nickel catalyst composition;

(d) subjecting said fluid having the fatty material dissolved therein obtained from step (c) to conditions which convert the fluid to a non-supercritical state;

(e) separating the fatty material from the fluid which is maintained in a non-supercritical fluid state; and (f) recovering the fatty material from step (e) and the supported nickel catalyst composition from step (c).

* * * * *

UNITED STATES PATENT AND TRADEMARK OFFICE

CERTIFICATE OF CORRECTION

PATENT NO. : 4,584,140

DATED : April 22, 1986

INVENTOR(S) : C. W. Blewett and S. W. Turner

It is certified that error appears in the above–identified patent and that said Letters Patent are hereby corrected as shown below:

The text beginning at column 8, line 42, through column 10, line 11, should be deleted and the following inserted therefor.

1. A process for treating a supported nickel catalyst composition containing a fatty material which comprises:

(a) contacting the supported nickel catalyst composition having up to 60 percent by weight fatty material associated therewith with an essential equimolar amount, based on the amount of nickel in the supported catalyst composition, of a mineral acid;

(b) contacting the acid-treated supported nickel catalyst composition obtained from step (a) with a fluid maintained in a supercritical state for a time sufficient to dissolve a substantial portion of the fatty material in said fluid;

UNITED STATES PATENT AND TRADEMARK OFFICE

CERTIFICATE OF CORRECTION

PATENT NO. : 4,584,140

DATED : April 22, 1986

INVENTOR(S) : C. W. Blewett and S. W. Turner

It is certified that error appears in the above-identified patent and that said Letters Patent are hereby corrected as shown below:

(c) separating said fluid having said fatty material dissolved therein and maintained in the supercritical state from the supported nickel catalyst composition;
(d) subjecting said fluid having the fatty material dissolved therein obtained from step (c) to conditions which convert the fluid to a non-supercritical state;
(e) separating the fatty material from the fluid which is maintained in a non-supercritical fluid state; and
(f) recovering the fatty material from step (e) and the supported nickel catalyst composition from step (c).

2. The process of Claim 1 wherein the fatty material is a fatty acid or lower alkyl ester thereof and constitutes from about 30 to 60 weight percent of the supported nickel catalyst composition.

3. The process of Claim 2 wherein the supercritical fluid is carbon dioxide maintained at a temperature from 31°C. to 100°C. and pressure from 1071 psi to 5000 psi.

4. The process of Claim 3 wherein the supported nickel catalyst composition is obtained from the hydrogenation of structurally modified fatty acids produced during the polymerization of unsaturated fatty acids.

5. The process of Claim 4 wherein the supercritical carbon dioxide is maintained at 35°C. to 65°C. and 2500 psi to 4000 psi.

6. The process of Claim 5 wherein the mineral acid is sulfuric acid.

UNITED STATES PATENT AND TRADEMARK OFFICE

CERTIFICATE OF CORRECTION

PATENT NO. : 4,584,140

DATED : April 22, 1986

INVENTOR(S) : C. W. Blewett and S. W. Turner

It is certified that error appears in the above-identified patent and that said Letters Patent are hereby corrected as shown below:

7. The process of Claim 6 wherein the supported nickel catalyst composition is a mixture of spent supported nickel hydrogenation catalyst with a non-nickel containing clay or earth material.

Signed and Sealed this

*Ninth* Day of *September 1986*

[SEAL]

*Attest:*

DONALD J. QUIGG

*Attesting Officer*

*Commissioner of Patents and Trademarks*